US005285178A

United States Patent [19]

Ahlberg

[11] Patent Number: 5,285,178

[45] Date of Patent: Feb. 8, 1994

[54] COMBINER RESONATOR HAVING AN I-BEAM SHAPED ELEMENT DISPOSED WITHIN ITS CAVITY

[75] Inventor: Christer M. Ahlberg, Vasteras, Sweden

[73] Assignee: Telefonaktiebolaget L M Ericsson, Stockholm, Sweden

[21] Appl. No.: 957,383

[22] Filed: Oct. 7, 1992

[51] Int. Cl.[5] ..... H01P 7/04

[52] U.S. Cl. ..... 333/224; 333/235

[58] Field of Search ..... 333/206, 207, 222-226, 333/231-233, 235; 334/82, 84; 331/101, 107 C

[56] References Cited

U.S. PATENT DOCUMENTS

| | | | |
|---|---|---|---|
| 2,577,511 | 12/1951 | Cohn | 333/207 |
| 3,020,499 | 2/1962 | Beiser et al. | 333/226 |
| 3,599,196 | 8/1971 | Boyke | 340/552 |
| 4,066,988 | 1/1978 | Karp | 333/223 |
| 4,292,610 | 9/1981 | Makimoto et al. | 333/222 |
| 4,386,326 | 5/1983 | Yoshimura | 331/96 |
| 4,445,100 | 4/1984 | Decker | 333/207 |
| 4,482,871 | 11/1984 | Stringfellow | 331/101 |
| 4,521,754 | 6/1985 | Ranghelli et al. | 333/224 |
| 4,535,302 | 8/1985 | Ward et al. | 330/287 |
| 5,070,313 | 12/1991 | Gladh et al. | 333/235 X |

*Primary Examiner*—Seungsook Ham

*Attorney, Agent, or Firm*—Burns, Doane, Swecker & Mathis

[57] ABSTRACT

In a combiner filter for a cellular telephone system, there is a coaxial resonator which includes a rectangular cavity. Within the rectangular cavity, there is a central conductor having an oval shaped plate. The central conductor and oval shaped plate are displaced within the rectangular cavity to establish the fundamental resonator frequency. Adjacent to the central conductor plate is a rotatable I-beam shaped element which is preferably rotated by a shaft coupled to a stepper motor. The rotation of the I-beam shaped element provides frequency adjustment or tuning for the coaxial resonator.

10 Claims, 2 Drawing Sheets

COMBINER RESONATOR HAVING AN I-BEAM SHAPED ELEMENT DISPOSED WITHIN ITS CAVITY

FIELD OF THE INVENTION

The present invention relates to a tuning arrangement for coaxial radio frequency (RF) combiner filters, and more especially to $\lambda/4$ resonators.

BACKGROUND OF THE INVENTION

A coaxial resonator includes a cavity such as a rectangularly shaped cavity, and the cavity's fundamental frequency, referred to as $f_o$, is usually set by selecting the relationship between a center conductor and the center conductor's closing cover (cap) which are disposed within the cavity. The closing cover and the opposite wall of the resonator cavity constitute the plates of a capacitor. The RF input signal, which is input to the cavity, produces an electric field between these capacitor plates and a magnetic field that is orthogonal to the electric field with maximum strength around the center conductor. The resonator's fundamental frequency is strongly determined by the center conductor's closing cover. The area of the closing cover determines the capacitance. The resonator is usually tuned, i.e., the resonator's fundamental frequency is selected, by adjusting the length of the center conductor, thereby changing the capacitance. This tuning is usually accomplished indirectly by moving an adjustment screw disposed in opposition to the center conductor. A pick-up loop, which is usually situated on one of the resonator's walls, is provided in the resonator. The loop picks up the tuned signal frequency (for setting the resonator, this frequency is the desired $f_o$).

A problem with the above-described conventional coaxial resonators is the difficulty of adjustment over a wide RF-bandwidth, e.g., 10 megahertz (MHz) around a center frequency of 465 MHz. Such wideband operation in connection with common adjustment means normally requires the use of bulky resonators. In a typical cellular telephone base station, there are, for example, eight resonators each handling two channels. If not all the resonators are used in the system, it is necessary to park the frequency for the unused resonators outside the active frequency band in order not to disturb other channels. The bulkiness and associated adjustment arrangements for the conventional resonators are so unsatisfactory, that there is a need for an entirely new design in order to alleviate the bulkiness associated with conventional designs.

SUMMARY OF THE INVENTION

The present invention provides a compact design for a coaxial resonator that is easy to adjust and provides a wider frequency tuning range. The coaxial resonator includes, in one embodiment, a rectangular cavity having a center conductor and an oval closing cap disposed within the rectangular cavity. The length and dimension of the center conductor and the shape of the closing cap determine the fundamental frequency of the coaxial resonator. Also disposed within the rectangular cavity is a rotatable I-beam shaped element. Preferably, a stepper motor and a connecting shaft rotate the I-beam shaped element. The rotation of the I-beam shaped element tunes the coaxial resonator. The I-beam shaped element may also be displaced laterally between the wall of the resonator and the closing cap to further facilitate the tuning of the resonator.

DETAILED DESCRIPTION OF THE INVENTION

Figure 1:
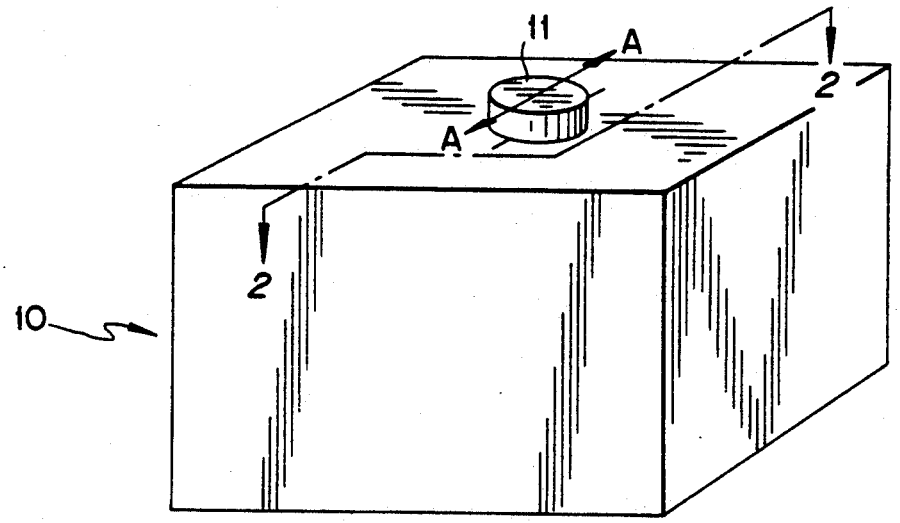
FIG. 1 is a perspective view of the coaxial resonator of the present invention.

Referring now to FIG. 1 there is a perspective view of one embodiment of the coaxial resonator of the present invention. The coaxial resonator includes a cavity such as the rectangular cavity 10. Disposed on the top of the rectangular cavity 10 is a stepper motor 11 or some other adjustment device such as an adjustment screw. Preferably, the stepper motor 11 is capable of being laterally displaced in the direction of the double arrow A—A.

Figure 2:
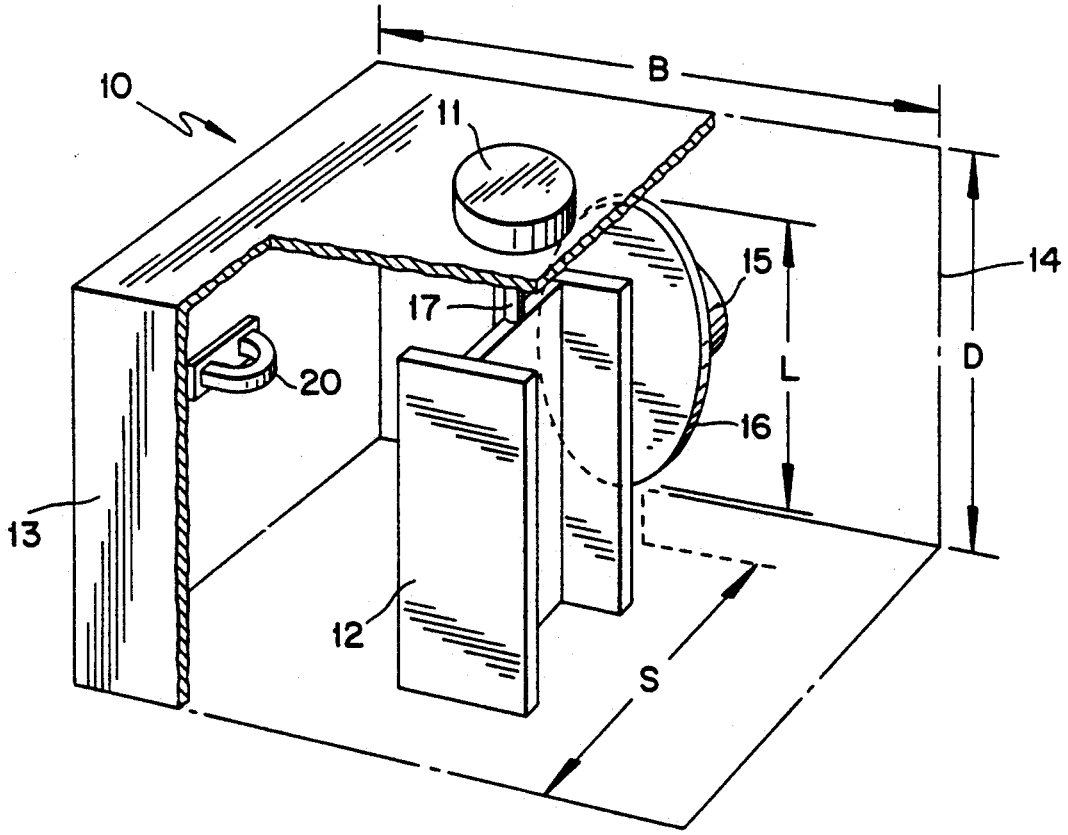
FIG. 2 is a cross sectional perspective view taken along the line 2—2 of FIG. 1.

Referring now to FIG. 2, a cross sectional perspective view taken along the line 2—2 of FIG. 1 is provided. Disposed within the rectangular cavity 10, there is an RF output coil 20 and an I-beam shaped element 12 orthogonally placed against the electrical field between the plates that make up the capacitor. The plates of the capacitor include the front wall 13 of the rectangular cavity 10 and the closing plate 16. The I-beam shaped element 12 has the property of introducing frequency adjustment (tuning) over a wide span when rotating the I-beam in the field. To achieve the same tuning span with prior art resonators, one would have to increase the length of the center conductor 15 in order to, for example, broaden the distance (S) between the capacitor plates 13, 16.

Figure 3:
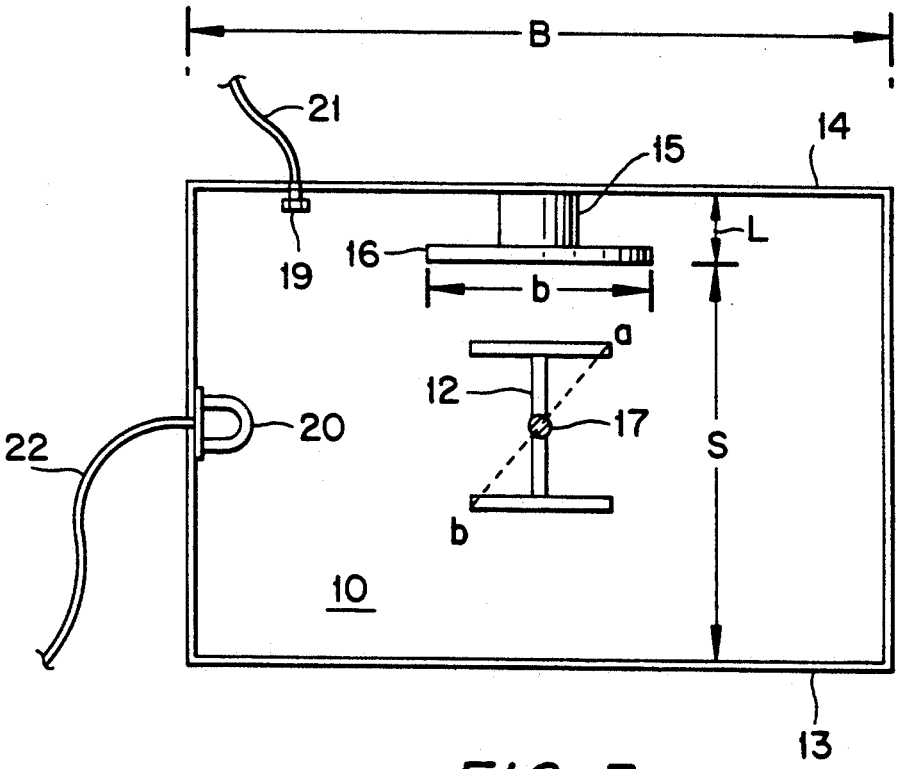
FIG. 3 is a plan view of the coaxial resonator with the top removed.

Referring now to FIG. 3, a plan view illustrates the rectangular cavity 10 with the top wall removed. An RF signal is input to the rectangular cavity via a coaxial cable 21 and a RF input loop 19. An RF signal is output from the rectangular cavity via a coaxial cable 22 and a RF output loop 20. The fundamental resonator frequency $f_o$ of the cavity 10 is settled through the adjustment length (L) of a coaxial center conductor 15 and/or its closing plate 16. The design and/or dimensions of the closing plate 16 also affect the adjustment of the fundamental resonator frequency $f_o$. According to the present invention, the rotation of the I-beam 12 is achieved with e.g., the stepper-motor 11, an adjustment screw or other known adjustment means which is attached to an isolated shaft 17.

A 90° rotation of the I-beam 12 adjusts the resonance frequency between maximum and minimum i.e., between 4 max and 4 min on a 360° rotation. The relation between the height and the width of the I-beam 12 when achieving maximum $\Delta f$ should be preferably 0.5. The diagonal dimension of the I-beam 12 is settled through the formula $S-(2^*(\geqq 10\text{ mm}))$ in order to accomplish maximum $\Delta f$ and good voltage flash-over resistance. The diagonal dimension is depicted in FIG. 3 by the dotted line a-b. The statement placed in the parenthesis is power related, meaning $<10$ mm for less power (high power being approximately 50 w).

The oval design of the closing plate or top-capacitance 16 improves the voltage isolation distance i.e., the S-measure increases. Improved $\Delta f$ through the oval shape of closing plate 16 is a consequence resulting from the increased projected surface of the I-beam 12. The design of the oval closing plate 16 is related to the resonator cavity dimensions through the equations, $b/B=k$, $k*D=1$, where k is a constant.

The present invention also makes it possible to move laterally the adjusting device 11 (See the double arrow A—A of FIG. 1 which illustrates the movement of the stepper motor), thereby causing the attached I-beam 12 to move laterally between the capacitor plates 13, 16. This lateral movement of the I-beam 12 facilitates the 'catch' of the correct frequency range including the location of $f_o$ via the so called parking frequency. Accordingly, the present invention provides a resonator, such as a $\lambda/4$-resonator, with a simple frequency adjustment means 11 which includes either a manual rotating device and/or an automatically driven device, for example, one driven by the stepper motor.

While the invention has been described in its preferred embodiments, it is understood that the words that have been used are words of description rather than of limitation, and that changes within the purview of the present claims may be made without departing from the true scope of the invention in its broader aspects.

I claim:

1. A coaxial resonator, comprising:

a cavity;

a conductive element, having a predetermined shaped plate, which is disposed within the cavity and connected to the cavity to provide a fundamental frequency for the coaxial resonator;

an I-beam shaped element disposed within the cavity between the plate and an opposing cavity wall, said plate and opposing cavity wall forming a capacitance, said I-beam shaped element being provided to tune the coaxial resonator; and means for rotating the I-beam shaped element within the cavity.

2. A coaxial resonator according to claim 1 wherein the cavity having a rectangular shape.

3. A coaxial resonator, comprising:

a rectangular shaped cavity;

a conductive element, having a predetermined oval shaped plate, which is disposed within the cavity and connected to the cavity, an I-beam shaped element disposed within the cavity between the plate and an opposing cavity wall, said plate and opposing cavity wall forming a capacitance; and means for rotating the I-beam shaped element within the cavity.

4. A coaxial resonator according to claim 3 wherein the means for rotating includes a stepper motor coupled to the I-beam shaped element via an isolated shaft.

5. A coaxial resonator according to claim 3 wherein the means for rotating includes a manually adjustable member coupled to the I-beam shaped element via an isolated shaft.

6. A coaxial resonator according to claim 3 wherein the means for rotating is laterally moveable such that the lateral movement of the means for rotating laterally displaces the I-beam shaped element.

7. A coaxial resonator according to claim 2 wherein the plate is oval shaped.

8. A coaxial resonator according to claim 1 wherein the means for rotating includes a stepper motor coupled to the I-beam shaped element via an isolated shaft.

9. A coaxial resonator according to claim 1 wherein the means for rotating includes a manually adjustable member coupled to the I-beam shaped element via an isolated shaft.

10. A coaxial resonator according to claim 1 wherein the means for rotating is laterally moveable such that the lateral movement of the means for rotating laterally displaces the I-beam shaped element.

* * * * *